United States Patent [19]

Veenema

[11] Patent Number: 4,491,321

[45] Date of Patent: Jan. 1, 1985

[54] PLAYING WALL

[75] Inventor: James Veenema, One Hale Ct., Huntington, N.Y. 11743

[73] Assignees: Howard Hammer, New City; George McFadden, Middle Village; James Veenema, Huntington, all of N.Y.

[21] Appl. No.: 428,699

[22] Filed: Sep. 30, 1982

[51] Int. Cl.[3] ..... A63B 61/00

[52] U.S. Cl. ..... 273/29 A; 52/125.2

[58] Field of Search ..... 273/29 A, 25, 410, 407, 273/396, 26; 272/3; 52/578, 579, 582, 585, 586, 125.2; 256/13.1

[56] References Cited

U.S. PATENT DOCUMENTS

| | | | |
|---|---|---|---|
| 2,989,155 | 6/1961 | Ocker | 52/125.2 |
| 3,697,068 | 10/1972 | McDougall | 273/29 A |
| 3,990,204 | 11/1976 | Haworth | 52/582 |
| 3,994,107 | 11/1976 | Aughuet | 52/582 |
| 4,070,018 | 1/1978 | Hodges | 273/29 A |
| 4,116,437 | 9/1978 | Johnson | 273/29 A |
| 4,197,685 | 4/1980 | Goulish | 52/582 |
| 4,309,032 | 1/1982 | Focius | 273/29 A |
| 4,373,720 | 2/1983 | Lombardi et al. | 273/29 A |

*Primary Examiner*—Richard C. Pinkham
*Assistant Examiner*—T. Brown
*Attorney, Agent, or Firm*—Lilling & Greenspan

[57] ABSTRACT

The improved playing wall consists of a multi-layered wall that is made in two sections. Each section has two outer surfaces made of two layers of a fiberglass polyester resin which sandwich a layer made of masonite. An impregnated paper honeycomb inner support section is located between the two outer sections. U-shaped supports extend around the periphery of each section of the wall, on all four sides. On the vertical sides of each wall, a tube is placed within the channel of the U-section and is secured to that section of the wall. Support fins, which flare out on either side of the wall, are secured to the tube.

5 Claims, 6 Drawing Figures

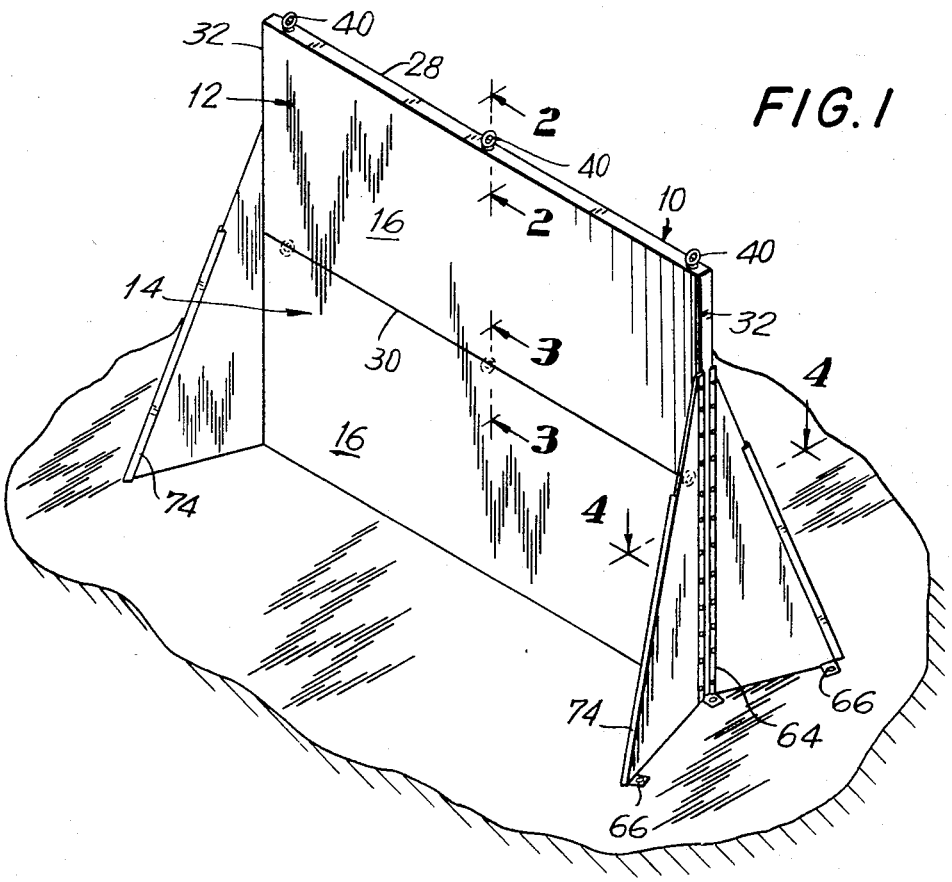
FIG. 1
FIG. 2
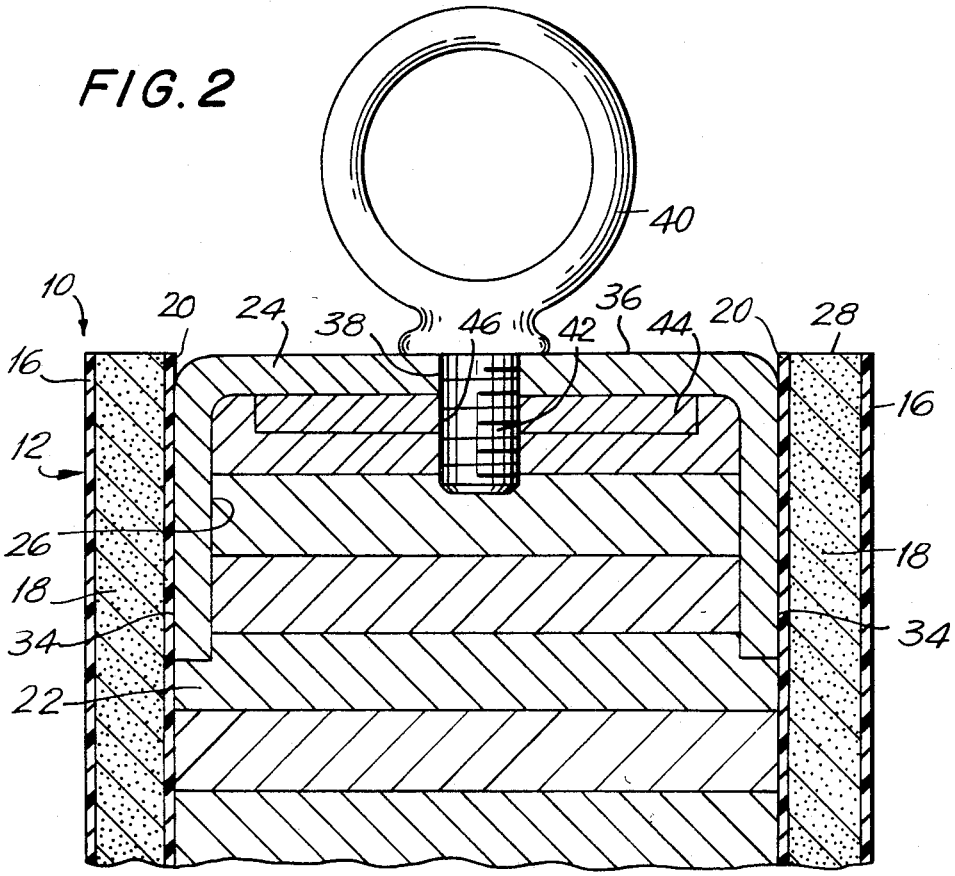

PLAYING WALL

BACKGROUND OF THE INVENTION

For many decades, many popular sports, such as paddleball and handball, have been played on the playing walls that proliferated in school yards in metropolitan areas. In addition to paddleball and handball, children have created many more uses for these playing walls, such as a backstop for stickball, tennis practice, etc. The walls in common use are usually made of poured concrete and are very heavy and expensive. As a result, as people have moved from the metropolitan areas to the suburbs, there has been a growing need for these playing surfaces in the suburbs. Because of the expense of concrete walls, other substitutes have been sought. One such substitute are walls made of wood, but these walls have not been found to be acceptable. Balls do not bounce well off of such surfaces and the useful life of such walls is very short. As a result, there is a very urgent need for a playing wall which is simple to construct, which is relatively inexpensive, and which has a long service life.

SUMMARY OF THE INVENTION

Therefore, it is an object of this invention to provide a simple and inexpensive playing surface which can be easily erected. This is accomplished by a multi-layered wall that is made in two sections. Each of the sections of the wall has two outer surfaces made of two layers of a fiberglass polyester resin which sandwich a layer made of Masonite. An impregnated paper honeycomb inner support section is located between the two outer sections. U-shaped supports extend around the periphery of each section of the wall, on all four sides. On the vertical sides of each wall, a tube is placed within the channel of the U-section and is secured to that section of the wall. Support fins, which flare out on both sides of the wall, are secured to the tube. Furthermore, because of the manner in which the wall is constructed and erected, it is easy to ship, by such means as truck. Moreover, the wall may be erected at the desired site within a relatively short period of time (i.e. hours, instead of days).

BRIEF DESCRIPTION OF DRAWINGS

FIG. 1 is a perspective view of the improved playing wall.

FIG. 2 is a cross-sectional view taken along lines 2—2 of FIG. 1.

DETAILED DESCRIPTION OF THE INVENTION

Figure 3:
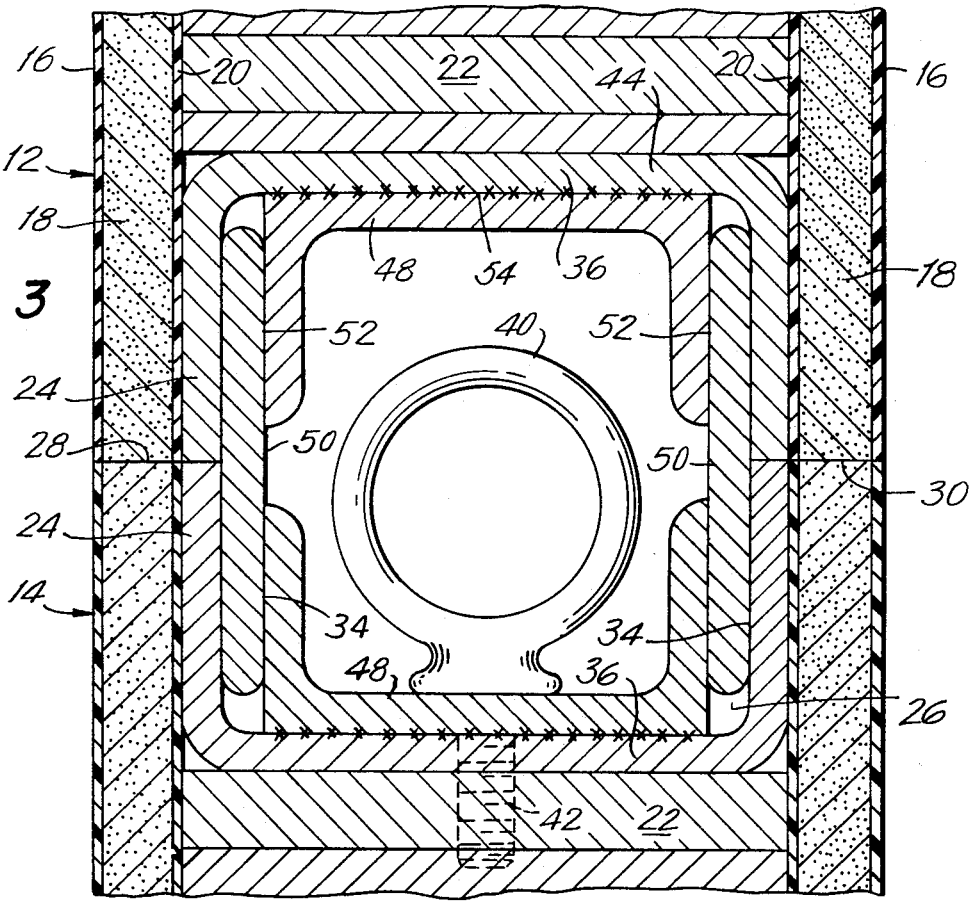
FIG. 3 is a cross-sectional view taken along lines 3—3 of FIG. 1.

The playing wall 10 may be made of any desired set of dimensions. In other words, the wall may be made of any size, and the size merely is dependent on the intended use of the wall. For a conventional twenty foot paddleball or handball court, it is suggested that the wall be twenty-two feet wide and sixteen feet high.

In the preferred embodiment of the invention, the playing wall 10 is made of an upper panel 12 and a lower panel 14; each of the panels is identical in construction. It has been found that making two panels, each being, for example, twenty-two feet wide and eight foot high, makes it possible to more easily transport the panels to the site of the playing wall. If the playing wall has sufficiently small dimensions, it is possible to make the wall of a single panel. In either case, the construction of each panel is identical and the wall would be erected in exactly the same manner.

As is best shown in FIG. 2 , each panel is multi-layered. (Though only the top panel is shown in FIG. 2 , it is understood that the bottom panel is constructed in like manner.) Each of the panels has an outer surface 16 which is used as the actual playing surface of the playing wall. Though the internal construction of the playing wall 10 will also have some effect on the manner on which balls bounce off the playing wall, the material out of which the outer surface 16 is made is highly critical to the efficacy of the wall. The material out of which the outer surface 16 is made must be suitable for playing surfaces, and it must provide a true and reliable bounce for the ball that strikes it. It has been found that many materials exist which would be suitable for the outer surface of the playing wall, such as wood, multi-layered plywood, cement or plaster. Though each of these materials will provide a relatively reliable bounce of the playing ball, it has been found that the preferable material is fiberglass polyester resin. This material provides the best balance of cost and reliability.

Immediately behind each of the outer surfaces 16 of the playing wall is a support panel 18. Though the outer surface is the surface that is actually struck by the ball, the resiliency of the support panel 18 is also very important. If the support panel is not made of the proper material, it will adversely effect the resiliency of the outer surface 16. Though materials such as fiberglass, steel, wood and other substances may be used, it has been found that Masonite provides the best results.

An inner support panel 20 is provided inside the playing wall 10, immediately behind respective support panels 18. Though these panels are relatively thin, they must be very strong and assist in supporting the playing wall. Any suitable material may be used for these panels and, in the preferred embodiments, the inner support panels 20 are made of fiberglass polyester resins.

A support core 22 is sandwiched between the various panels and provides the basic support and strength of the playing wall. Many different materials, such as steel, wood, fiberglass or urethane foam, may be used for the support core. In the preferred embodiments, the support core 22 is made of impregnated paper honeycomb.

One of the reasons that, in the preferred embodiments, the above mentioned materials are selected is that these materials are easily affixed to each other. For example, fiberglass polyester resins and Masonite are sufficiently compatible that these two materials can be cured together. As for the fiberglass polyester resin and the impregnated paper honeycomb, these two materials may also be cured together. Thus, it is possible to assemble the upper and lower panels of the wall without the need for bolts or other fastening means. Instead of curing the materials together it is also possible to use adhesives. In any event, the important point is that the outer surfaces 16, the support panels 18, the inner support panels 20 and the support core 22 must be tightly affixed to each other in order to create a single, solid playing wall 10.

Figure 4:
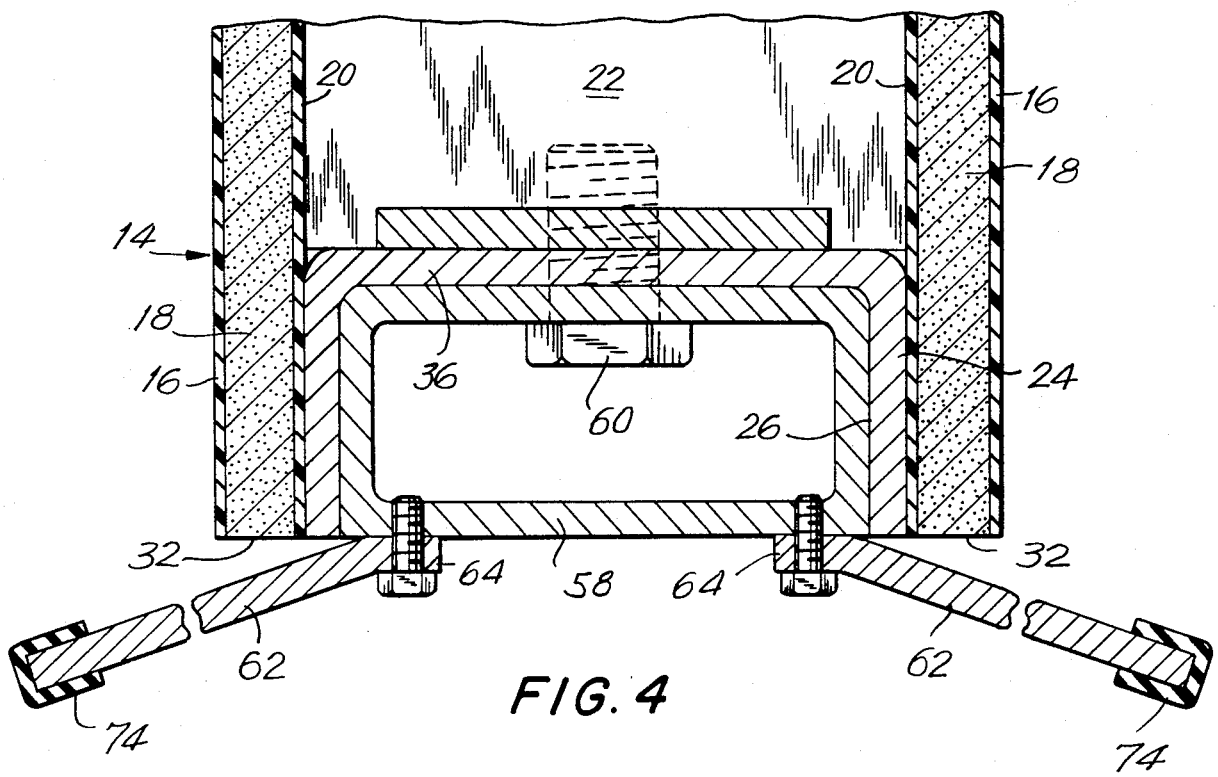
FIG. 4 is a cross-sectional view taken along lines 4—4 of FIG. 1.

The upper and lower panels 12 and 14 of the playing wall 10 are each provided with four U-shaped pultrusions 24. The pultrusions are placed around the periphery of each of the panels of the playing wall, and are located on all four sides. As shown in FIG. 4, the channels 26 of the pultrusions 24 are directed away from the side surfaces 32 of the panels 12 and 14. The pultrusions may be made of any strong material, such as aluminium or steel; in the preferred embodiments, the pultrusions are made of fiberglass.

FIG. 2 shows the construction of one of the panels and shows the upper surface 28 of that panel. (It is noted that the lower surface 30 of each panel 12 and 14 is constructed in a similar manner.) The pultrusion 24 extends from one side surface 32 of the upper surface 28 of the panel 12 or 14, along the entire upper surface, to the other side surface 32 of the panel 12 or 14. The side surface 34 and the base surface 36 of the pultrusion 24 define the channel 26. The side surfaces 34 of the pultrusion are flush against the inner support panels 20 and are affixed to them, in any suitable manner. This may be by bolts or other fasteners, or adhesives; in the preferred embodiment, the pultrusions and the inner support panels 20 are cured together. As shown in FIG. 2, the base surface 36 of the pultrusion 24 may be flush, or nearly flush, with the upper surface 28; alternatively, as shown in FIG. 3, the base surface 36 of the pultrusion 24 may be flush with an upper end of the support core 22 and may be affixed to it in any suitable manner, such as by curing.

In order to erect the playing wall, at various points along its base surface, the pulstrusion 24 is provided with openings 38. A closed ring 40 or an open hook (not shown) may then be suitably attached to the pultrusion by any suitable means. A bolt 42 of the ring 40 may pass through a respective opening 38 in the pultrusion and be secured by a nut (not shown). As shown in FIGS. 2 & 3, the bolt 42 of the ring 40 may pass through the opening 38 and be held securely within the support core 22. In some arrangements, a plate, preferably made of steel, is bonded to the inner surface of the base surface 36 of the pultrusion. The plate 44 is positioned by a respective opening 38 and has an opening 46 in alignment with the opening 38. The bolt 42 may then be threaded into the steel plate 44 and securely held. The plate 44 may be secured to the pultrusion by adhesives or by bonding or by any other suitable method. It is not necessary for the plate 44 to extend the entire length of the base surface 36 of the pultrusion; it is sufficient for it to extend merely in an area around a respective opening 38. As will be explained hereinafter, the rings 40 are used to lift the upper panel 12 ( or the lower panel 14) into position. Any appropriate number of rings 40 may be provided along the upper (28) or lower (30) surface of the panels 12 or 14. In the preferred embodiments, it has been found that two or three rings are more than adequate, and one ring is frequently sufficient.

As is best shown in FIG. 3, some additional elements are required when the upper and lower panels 12 and 14 are joined. For this purpose, a second U-shaped pultrusion 48 is provided. A flat pultrusion 50 is provided between the side surfaces 52 of the pultrusion 48 and the side surfaces 34 of the pultrusion 24. Further, it is noted that the second U-shaped pultrusion 48 and the flat pultrusion 50 may be made of the same material as the U-shaped pultrusion 24. As shown in FIG. 3, the upper surface 28 of the lower panel 14 has the channel 26 of the pultrusion 24 facing outward (toward the lower surface 30 of the upper panel 12). The base 36 of the pultrusion 24 is adhered to an upper portion of the support core 22, as described previously. The second pultrusion 48 is oriented in the same direction and the base 54 of the second pultrusion 48 adheres to the outer surface of the base 36 of the first pultrusion 24; this may be done in any appropriate manner. The bolt 42 of the ring 40 passes through the bases of the two pultrusions and is secured, as by a steel plate. Wedged between the side surfaces 34 of the pultrusion 24 and the side surfaces 52 of the pultrusion 48 are the flat pultrusions 50. Initially, these flat pultrusions 50 are wedged between the side surfaces of the two pultrusions, and then the materials adhere to each other. It is noted that the second U-shaped pultrusion 48 and the flat pultrusion 50 should likewise extend the entire length of the playing wall 10. The arrangement and construction of the lower surface 30 of the upper panel 12 is made in the same manner as is the upper surface 28 of the lower panel 14.

Figure 5:
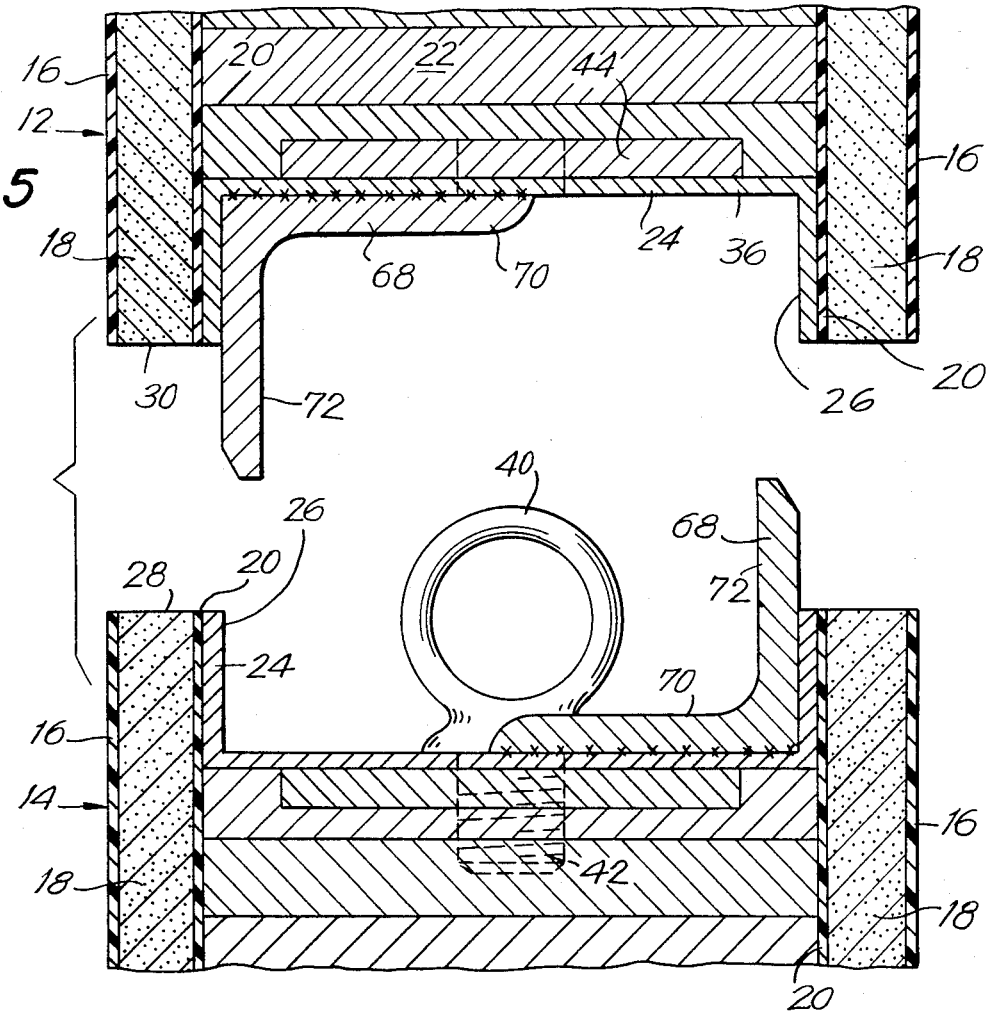
FIG. 5 is an exploded cross-sectional view similar to FIG. 6.
Figure 6:
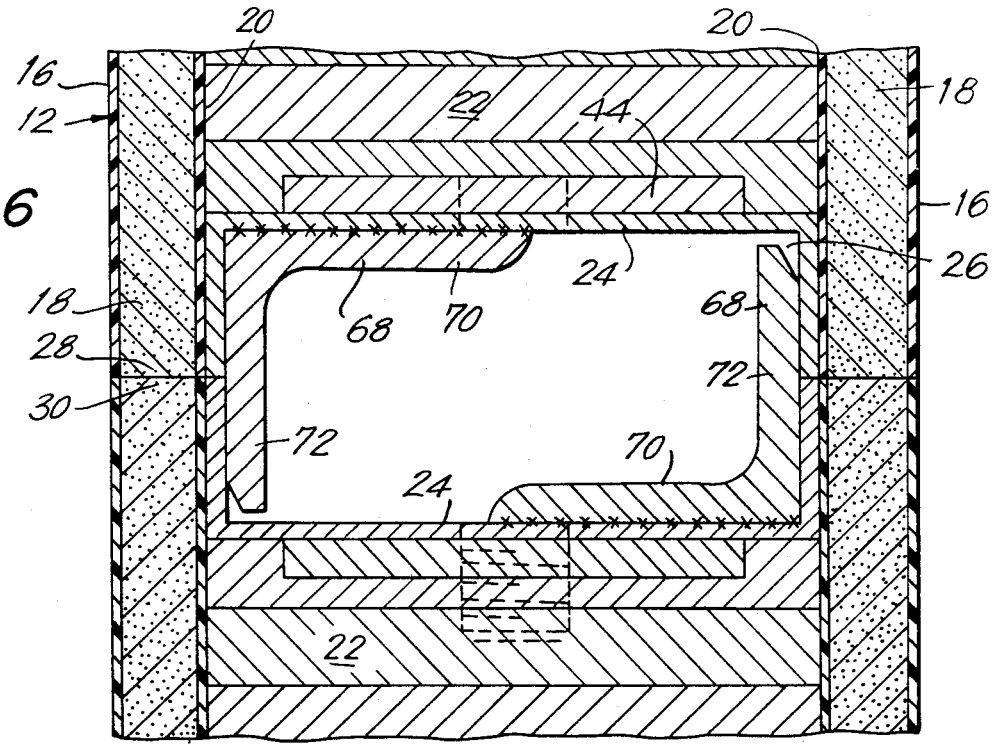
FIG. 6 is a cross-sectional view similar to FIG. 3, but showing an alternate embodiment of the invention.

FIGS. 5 & 6 show an alternate emobodiment, showing another manner in which the upper and lower panels 12 and 14 may be joined together. The upper surface 28 of the lower panel 14 and the lower surface 30 of the upper panel 12 are both provided with the U-shaped pultrusions 24, that were described with regard to the other embodiment. In addition, with regard to both the upper and lower panels 12 and 14, an L-shaped pultrusion 68 is provided. As was the case with the U-shaped pultrusions 24 and 48, the L-shaped pultrusion 68 may be made of any suitable material, such as steel or aluminum; in the preferred embodiments, fiberglass is generally used. With regard to each of the L-shaped pultrusion 68, a first leg 70 is bonded to the base 36 of the U-shaped pultrusion 24, and the second leg 72 extends outward from the respective panel 12 or 14. As shown in the drawing, one of the L-shaped pultrusions is positioned on the right side of one of the panels, and the other L-shaped pultrusion is positioned on the left side of the other panel. After the walls are joined, the distal ends of the second leg 72 are bonded to side surfaces 34 of the U-shaped pultrusion 24 on the other panel.

As heretofore described, the channel 26 of the pultrusions 24 on the side surfaces 32 of the panels 12 and 14 face outwardly (away from the inner sections of the playing wall 10). A rectangular tube 58 is placed within the channel 26. Appropriate anchor bolts 60 are passed through the tube 58 and through appropriate openings in the base 36 of the pultrusion 24 and secured to steel plates on the inner surface of the pultrusion. Any appropriate number of anchor bolts may be used. Alternatively, any other suitable means may be used for attaching the tube to the playing wall 10. The tube may be made of any suitable material, such as steel, or wood or aluminum. In the preferred emobdiment, the tube is made of aluminum.

Two support fins 62 are attached to each tube 58 and extend outward from the playing wall 10 at an angle to the plane of the playing wall. The fin 62 may be made of any strong material that will support the wall, such as steel. In the preferred emobdiment, the fins are triangular in shape, but they may be made of any other appropriate shape. The vertical edge 64 of each fin 62 is attached to the respective tube 58 by any suitable means, such as by welding or anchor bolts. The horizontal edge is appropriately secured to the floor (or other support horizontal surface) in any suitable manner, such as by anchor bolts.

The playing wall may be erected, according to the invention, in the following manner. The dimensions of the required playing surface are determined and, depending on the required dimensions, either one panel is manufactured or upper and lower panels 12 and 14 are manufactured. As heretofore described, the outer surfaces 16, the support panels 18, the inner support panels 20 and the support core 22 of each panel are cured together until there is a finished panel. The required number of support rings 40 are affixed to the upper surface 28 of the lower panel 14 and to the upper surface 28 of the upper panel 12.

To erect the playing wall, one of the rectangular tubes 58 (either the right or left tube) is put into position. A L-shaped bracket and anchor bolt may be used to secure the rectangular tube to the horizontal playing surface (the ground or floor). Thereafter a crane or back hoe (or any other suitable device) lifts the lower panel 14 by the support ring 40 (or rings 40). As the lower panel 14 is lowered into position, the channel 26 of the pultrusion 24 on the appropriate side surface 32 of the lower panel 4 is guided, so that the rectangular tube 58 will enter into the channel 26. After the lower panel 14 is resting on the ground, anchor bolts, or other suitable means, are used to attach the rectangular tube 58 to the respective pultrusion 24. It is noted that the rectangular tube 58 will be extending above the upper surface 28 of the lower panel 14 on one side, because the tube will be extending into the channel 26 of the pultrusion 24 on the same side surface 32 of the upper panel 12.

The support fins 62 are now attached to the tube 58. The vertical edge 64 of the support fins 62 may be angled slightly to assist in attaching the fins to the tube 58, or a suitable bracket may be used. In either case, welding is generally preferred for attachment. Thereafter, the horizontal edges 66 are bolted to the ground. This may be accomplished by the use of brackets or by bending the horizontal edge 66 of the fins 62. (In some cases, it may be desirable to attach the support fins 62 to the tube 58 before the playing wall is erected.)

At this point, the flat pultrusions 50 are wedged between the side surfaces 52 of the second U-shaped pultrusions 48 and the side surfaces 34 of the pultrusions 24 on the lower surface 30 of the upper panel 12. Thereafter, the upper panel is appropriately lifted into position by the ring 40 (or rings 40) on the upper surface 28 of the upper panel 12. As the upper panel 12 is lowered into position, the rectangular tube 58 is guided into the channel 26 of the pultrusion 24 on the same side surface 32 of the upper panel 12. Additionally, the flat pultrusions 50, which extend out from the lower surface 30 of the upper panel 12 are wedged between the side surfaces 52 of the U-shaped pultrusion 48 and the side surfaces 34 of the U-shaped pultrusion 24 on the upper surface 28 of the lower panel 14. When the upper panel 12 is finally positioned, the upper surface 28 of the lower panel 14 and the lower surface 30 of the upper panel 12 will be flush with each other, as shown in FIG. 3. It will also be seen that the flat pultrusions 50 adhere to the surfaces surrounding them and assist in holding the panel together. Further, because of the channels 26 and 56 of the pultrusions 24 and 48, it is not necessary to remove the ring 40 (or rings 40) from the upper surface 28 of the lower panel 14. After the upper panel 12 is in position, anchor bolts, or other suitable means, are used to attach the tube 58 to the upper panel 12. This is done in the same manner as was done to attach the tube 58 to the lower panel 14. Alternatively, when using the second embodiment of the invention, it is noted that the second leg 72 of the L-shaped pultrusion 68 extend outward from the respective panels 12 or 14. Thereafter, the upper panel is appropriately lifted into position by the ring 40 (or rings 40) on the upper surface 28 of the upper panel 12. As the upper panel 12 is lowered into position, the rectangular tube 58 is guided into the channel 26 of the pultrusion 24 on the same side surface 32 of the upper panel 12. In addition, the second leg 72 will now come into contact with respective side surfaces 34 of the U-shaped pultrusions 24 on the opposite panel. Because of the materials out of which the pultrusions are made, the second legs 72 of the L-shaped pultrusion 68 will become bonded to the side surfaces 34 of the U-shaped pultrusions 24. After the upper panel 12 is in position, and the L-shaped pultrusions 68 have been bonded to the U-shaped pultrusions 24, anchor bolts, or other suitable means are used to attach the tube 58 to the upper panel 12. This is done in the same manner as was done to attach the tube 58 to the lower panel 14.

After the upper panel 12 is positioned, the second tube 58 is positioned on the other side surface of the upper and lower panels 12 and 14. The connection of the tube 58 is done in the same manner as was used in attaching the other tube 58 on the other side surfaces of the upper and lower panels 12 and 14. Thereafter, the support fins 62 are similarly attached to the newly positioned tube 58.

After the lower panel is positioned, in some cases it may be desirable to remove the ring 40 (or the rings 40). Though there is room for these rings within the channels 26 of the U-shaped pultrusions, it may be more desirable to remove the rings. In some embodiments of the invention, it may be desirable to place support rods on the top of the wall to support a small fence or netting over the wall, to catch errant balls.

The vertical edge 64 of the fins 62 may extend to the very top of the playing wall 10, but it has been found that sufficient support will be provided if the vertical edge 64 extends only three-fourths of the way up the playing wall 10. If desired, the tube 58 may extend only as far as the top edge of the vertical edge 64 of the fins 62.

In an alternate embodiment of the invention, it is possible to take the outer skin of the playing wall 10 and attach it to an existing vertical structure, such as the wall of a building. The outer skin of the playing wall 10 would generally consist of the outer surface 16, the support panel 18 and the inner support panel 20 of one of the panels 12 or 14. In such a manner, a vertical wall, or other structure, could be converted to a very acceptable playing surface.

In still another embodiment of the invention, the entire plavinq wall may be made portable. In such case, wheels may be secured to jacks (which may be hydraulic or mechanical), which are, in turn, attached to the support fins. When the playing wall is in position, the hydraulic jacks are lifted and the playing wall rests on the playing surface (the ground). When it is desired to move the playing wall, the hydraulic jacks are activated and the wheels are lowered until the playing wall is lifted above the playing surface and the wheels are free to rotate. At this point, any suitable mechanical device may be used to push or pull the playing wall to the new location.

The improved playing wall of this invention is very strong and is capable of withstanding hurricane winds, and forces exceeding 15 pounds per square foot. Further, the improved playing wall of this invention is superior to the concrete walls now in use and will have a longer service life than such walls. Further, unlike the concrete walls now in use, the improved playing wall will not crack and has an almost indefinite life span, as compared to the concrete playing walls.

In order to protect the persons using the improved playing wall, rubber edging 74 may be provided on the support fins 62. This will insure that they are not cut by the sharp edges on the support fins.

I claim:

1. An improved substantially vertical playing wall comprising at least one playing panel comprising two outer playing surfaces, two support panels affixed to inner surfaces of respective outer playing surfaces, two inner support panels affixed to inner surfaces of respective support panels, and a support core affixed between said inner support panels; U-shaped pultrusions having channels and being positioned around the periphery of said playing panel and having side surfaces affixed to said inner support panels; tube means positioned in said channels of said U-shaped pultrusions and extending along vertical side edges of said playing panel; and, support fins affixed to said tube means and extending at an angle to the plane of the playing panel.

2. An improved playing wall according to claim 1, further comprising upper and lower playing panels; and, L-shaped pultrusions, each L-shaped pultrusion having one leg attached to said U-shaped pultrusion on an upper or lower surface of one of said playing panels and another leg attached to the lower or upper surface of the other plaving panel.

3. An improved playing wall according to claim 1, further comprising two playing panels; additional U-shaped pultrusions positioned on a lower surface of an upper playing panel and on an upper surface of a lower playing panel, and being positioned within the channel of a respective U-shaped pultrusion and adhering to the side surfaces of said respective U-shaped pultrusion; and, flat pultrusions wedged between side surfaces of the U-shaped pultrusions and the additional U-shaped pultrusions of both playing panels.

4. An improved playing wall according to claim 1, wherein the outer playing surfaces and the inner support panels are made of fiberglass polyester resins, the support panels are made of Masonite, the support core is made of impregnated paper honeycomb, and the U-shaped pultrusions are made of fiberglass.

5. An improved playing wall according to claim 1, further comprising support rings affixed to upper surfaces of said playing panels.

* * * * *